US008347947B2

(12) United States Patent
Dube et al.

(10) Patent No.: US 8,347,947 B2
(45) Date of Patent: Jan. 8, 2013

(54) PROCESS AND REFRACTORY METAL CORE FOR CREATING VARYING THICKNESS MICROCIRCUITS FOR TURBINE ENGINE COMPONENTS

(75) Inventors: Bryan P. Dube, Columbia, CT (US); Ryan Shepard Levy, Middletown, CT (US); Richard H. Page, Guilford, CT (US)

(73) Assignee: United Technologies Corporation, Hartford, CT (US)

( * ) Notice: Subject to any disclaimer, the term of this patent is extended or adjusted under 35 U.S.C. 154(b) by 864 days.

(21) Appl. No.: 12/372,181

(22) Filed: Feb. 17, 2009

(65) Prior Publication Data

US 2010/0206512 A1 Aug. 19, 2010

(51) Int. Cl.
*B22C 9/10* (2006.01)
*B28B 7/28* (2006.01)

(52) U.S. Cl. ..... 164/369; 249/175

(58) Field of Classification Search ..... 164/132, 164/340, 6, 32, 28, 230, 365, 369
See application file for complete search history.

(56) References Cited

U.S. PATENT DOCUMENTS

| | | | | |
|---|---|---|---|---|
| 7,108,045 | B2 * | 9/2006 | Wiedemer et al. | 164/369 |
| 7,780,414 | B1 * | 8/2010 | Liang | 416/97 R |
| 2005/0098296 | A1 * | 5/2005 | Beals et al. | 164/369 |
| 2008/0008599 | A1 * | 1/2008 | Cunha et al. | 416/97 R |

FOREIGN PATENT DOCUMENTS

| | | | |
|---|---|---|---|
| EP | 1358954 | A1 | 11/2003 |
| EP | 1524046 | A1 | 4/2005 |
| EP | 1715139 | A2 | 10/2006 |
| EP | 1854567 | A2 | 11/2007 |
| EP | 1865151 | A2 | 12/2007 |
| EP | 1878874 | A2 | 1/2008 |
| EP | 1914030 | A1 | 4/2008 |

* cited by examiner

*Primary Examiner* — Kevin P Kerns
*Assistant Examiner* — Steven Ha
(74) *Attorney, Agent, or Firm* — Bachman & LaPointe, P.C.

(57) ABSTRACT

The present disclosure is directed to a refractory metal core for use in forming varying thickness microcircuits in turbine engine components, a process for forming the refractory metal core, and a process for forming the turbine engine components. The refractory metal core is used in the casting of a turbine engine component. The core is formed by a sheet of refractory metal material having a curved trailing edge portion integrally formed with a leading edge portion.

10 Claims, 3 Drawing Sheets

PROCESS AND REFRACTORY METAL CORE FOR CREATING VARYING THICKNESS MICROCIRCUITS FOR TURBINE ENGINE COMPONENTS

BACKGROUND

The present disclosure relates to a refractory metal core for use in forming varying thickness microcircuits in turbine engine components, a process for forming said refractory metal core, and a process for forming said turbine engine components.

Turbine engine components are typically formed using a casting technique in which a ceramic core is placed within a mold and later removed, leaving certain cooling features within the turbine engine component.

The use of ceramic cores does not easily allow the formation of intricate cooling schemes which are needed for turbine engine components which are used in high temperature environments.

SUMMARY OF THE INVENTION

In a first aspect, the present disclosure is directed to a process for forming a turbine engine component broadly comprising the steps of: providing a non-ceramic core formed predominantly from a refractory metal material; providing a mold having a shape of said turbine engine component; positioning only said core within said mold; introducing a molten metal material into said mold and allowing said molten metal material to solidify and form said turbine engine component; and removing said core from said solidified turbine engine component.

In a second aspect, the present disclosure is directed to a process for forming a refractory metal core for use in a turbine engine component casting system broadly comprising the steps of: providing a piece of refractory metal material having a substantially flat side; subjecting said piece of refractory metal material to a rolling operation to form a curvature in said refractory metal material; and fabricating said piece of refractory metal material to have different thicknesses in different portions.

In a third aspect, the present disclosure is directed to a core to be used in the casting of a turbine engine component, said core broadly comprising: a sheet of refractory metal material; and said sheet having a curved trailing edge portion integrally formed with a leading edge portion.

Other details of the process and refractory metal core for creating varying thickness microcircuits for turbine engine components, as well as advantages and objects attendant thereto, are set forth in the following detailed description and the accompanying drawings wherein like reference numerals depict like elements.

DETAILED DESCRIPTION OF THE PREFERRED EMBODIMENT(S)

As noted above, the present disclosure is directed to an improved process for forming turbine engine components having an airfoil portion with one or more as cast cooling microcircuits and to a refractory metal material core for use in the casting system.

Figure 1:
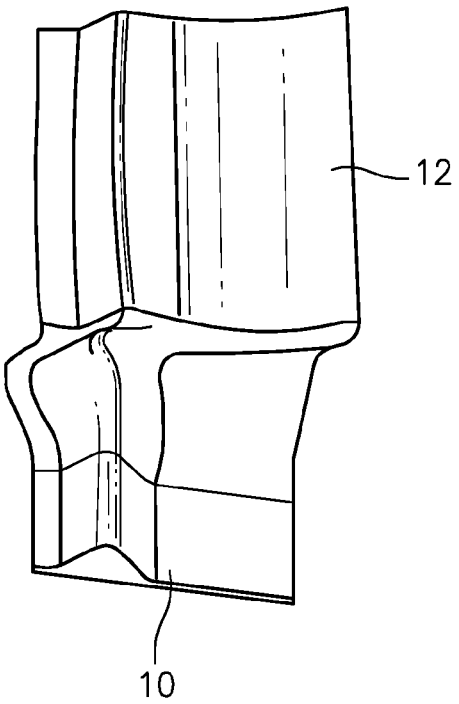
FIG. 1 illustrates a piece of a refractory metal material for use as a core.

Referring now to the drawings, a piece 10 of refractory metal material, such as a piece formed solely from molybdenum or a molybdenum based alloy (an alloy having more than 50 wt % molybdenum) is provided. Preferably, the piece 10 has one substantially flat side. The piece 10 is then subjected to rolling operation to change its curvature and form a curved trailing edge portion 12 as shown in FIG. 1. The rolling operation may be formed by any suitable rolling equipment such as a toggle press roll machine.

Figure 2:
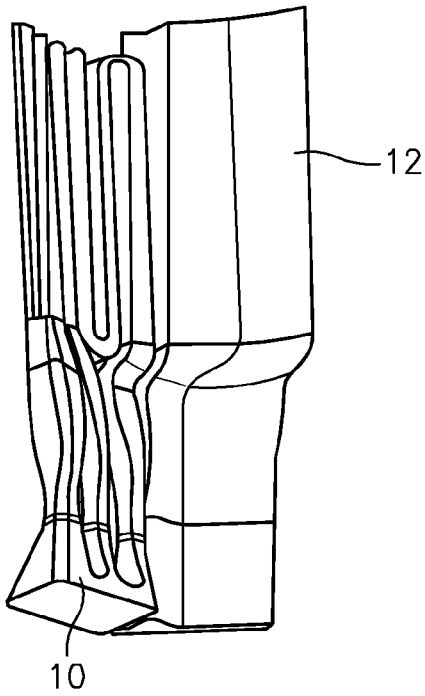
FIG. 2 illustrates a refractory metal material core which has been rolled and subsequently formed.

Following the rolling operation, the piece 10 may be subjected to one or more forming operations. For example, in FIG. 2, the piece 10 has been cut to begin the formation of one or more cooling circuits.

Figure 3:
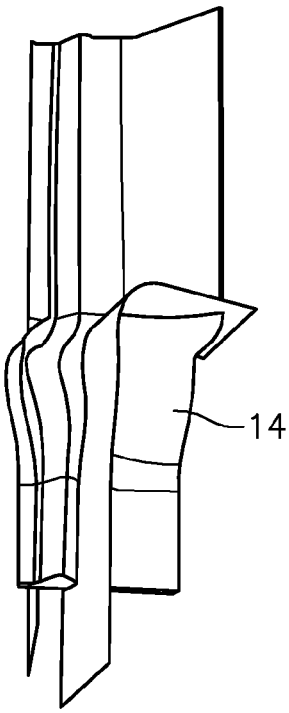
FIG. 3 illustrates further machining of the refractory metal material core.

As shown in FIG. 3, the thickness of the piece 10 may be altered using a wire EDM approach and/or a shear technique. The shear technique may comprise a technique where all of the outer edges of the piece 10 are cut off at once. Also, the height of the piece 10 may be altered as shown at the top of the figure. Still further, portions of the piece, such as portion 14, may be removed. Removal of the material in this manner allows the formation of consistently small radii, on the order of approximately 0.015 inches, with media finish. This is very useful for forming the leading and trailing edge shapes of a turbine engine component such as a stator.

Figure 4:
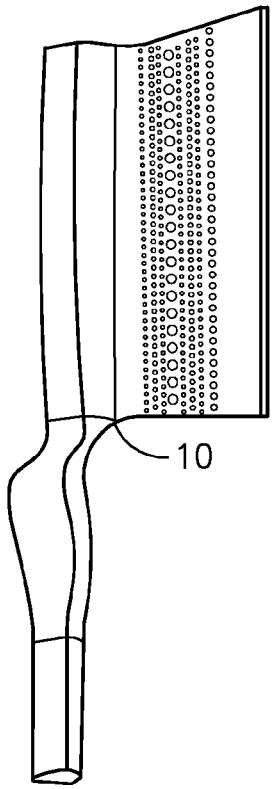
FIG. 4 illustrates a portion of the refractory metal core machined to provide additional features.

As shown in FIG. 4, the piece 10 may be subjected to additional forming operations to add other features such as pedestal arrays and/or trip strip arrays. To form the pedestal arrays, a plurality of holes may be cut into the piece 10. To form trip strip arrays, a plurality of slots may be cut into the piece 10.

Figure 5:
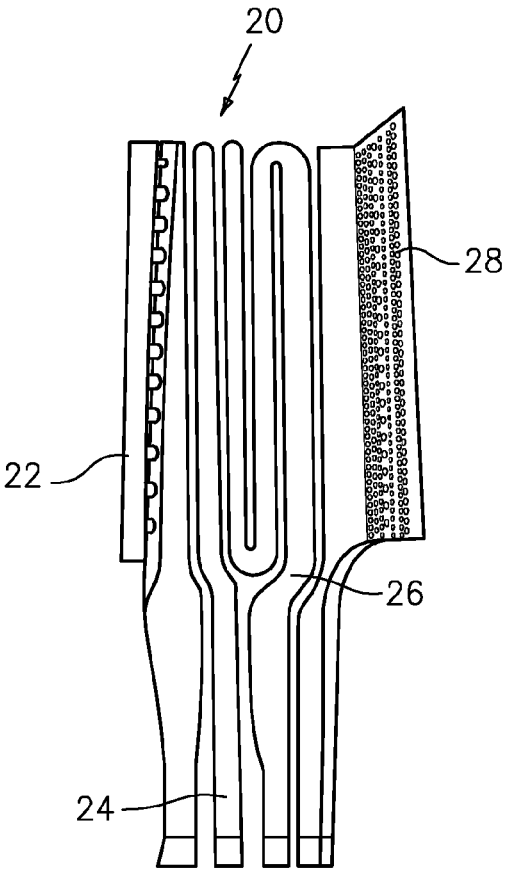
FIG. 5 illustrates a front view of as refractory metal material core for use in a turbine engine component casting system.
Figure 6:
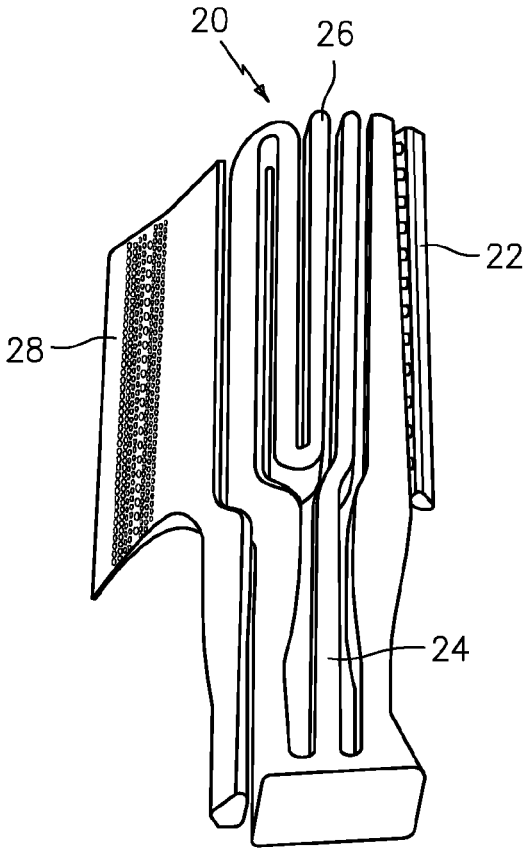
FIG. 6 illustrates a rear view of the refractory metal core of FIG. 5.
Figure 7:
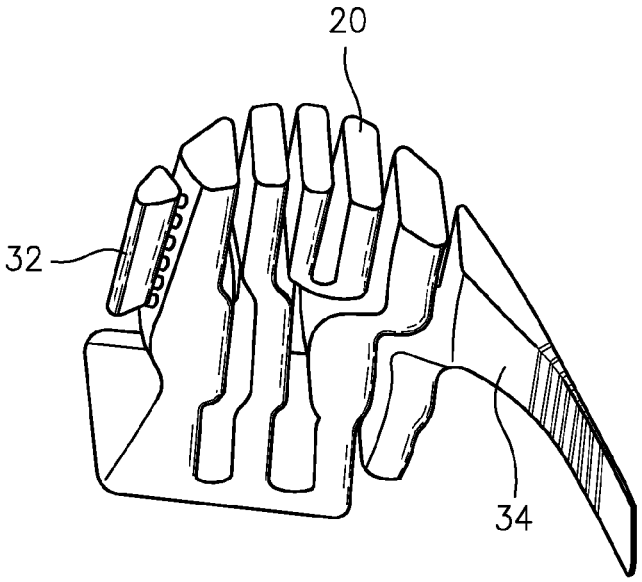
FIG. 7 is a perspective view of the refractory metal core of FIG. 5 showing the varying thickness of the core.

Referring now to FIGS. 5-7, there is shown a refractory metal material core 20 which may be formed using the aforesaid technique. The core 20 may have a first portion 22 which has the shape of and is used to form a leading edge cooling microcircuit. It may also have a second portion 24 which has the shape of and is used to form an internal cooling microcircuit, a third portion 26 which has a serpentine configuration and is used to form a serpentine shaped cooling microcircuit, and a trailing edge portion 28 which is configured to form a trailing edge cooling microcircuit.

As can be seen from FIG. 7, the refractory metal material core 20 may have a varying thickness from a leading edge portion 32 to a trailing edge portion 34. Further, the refractory metal material core 20 may have a desired curvature which forms the interior of the airfoil portion of the turbine engine component.

Figure 8:
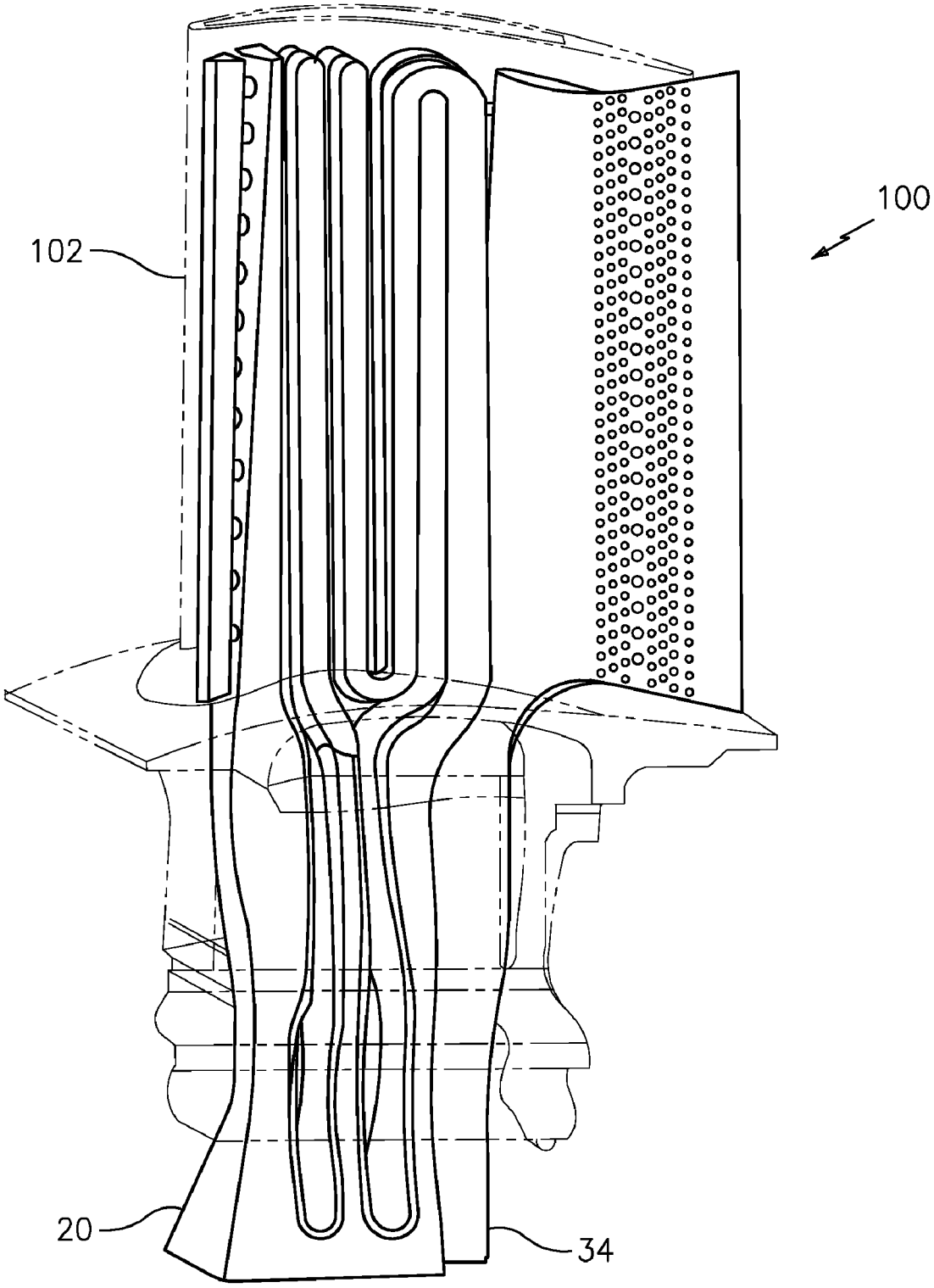
FIG. 8 illustrates placement of the refractory metal core in a mold for forming a turbine engine component.

Referring now to FIG. 8, there is shown a system 100 for casting an airfoil portion of a turbine engine component such as a turbine blade or stator. The system 100 includes a mold 102 which takes the form of the exterior of the turbine engine component. Within the mold 102 is placed the refractory metal material core 20. This system differs from those systems wherein a ceramic material core is placed within the mold. In such systems, refractory metal cores for forming certain features were attached to the ceramic material core via one or more glue joints. The system described herein is particularly useful since it avoids the glue joints and avoids thermal mismatches between ceramic and refractory metal materials. Other problems which are avoided by the system described herein include highly variable hand assembly, die qualification of internal features, and increases in part due to the presence of one or more joints. The system described herein is also advantageous because it allows the use of thick refractory metal strips which can be processed into complex, varying thickness, 3-D geometries. The use of a refractory metal material core allows more intricate cooling schemes, particularly in the trailing edge, which result in improved convection cooling which has not been attainable using conventional ceramic core technology.

There has been provided in accordance with the instant disclosure a process and refractory metal core for creating varying thickness microcircuits for turbine engine components. While the process and core have been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A core to be used in the casting of a turbine engine component, said core comprising:

a single sheet of refractory metal material;

said single sheet having a curved trailing edge portion and a leading edge portion;

said leading edge portion having a first cooling circuit portion machined therein and said trailing edge portion having a second cooling circuit machined therein; and said single sheet further having a portion with a serpentine configuration intermediate said trailing edge portion and said leading edge portion.

2. The core according to claim 1, further comprising at least one additional cooling circuit portion located adjacent said portion with said serpentine configuration.

3. The core according to claim 2, further comprising an array of holes for forming an array of pedestals in at least one of said cooling circuit portions.

4. The core according to claim 2, further comprising an array of slots for forming an array of trip strips in at least one of said cooling circuit portions.

5. The core according to claim 1, wherein said refractory metal material consists of a material selected from the group consisting of molybdenum and a molybdenum alloy.

6. The core according to claim 2, wherein said at least one additional cooling circuit portion has a non-serpentine configuration.

7. The core according to claim 2, wherein said at least one additional cooling circuit portion is located between said leading edge portion and said portion having said serpentine configuration.

8. The core according to claim 1, wherein said core has a thickness which varies from said leading edge portion to said trailing edge portion.

9. The core according to claim 1, wherein said core is non-linear from said leading edge portion to said trailing edge portion.

10. The core according to claim 2, wherein said leading edge portion, said portion with said serpentine configuration, and said at least one additional cooling circuit portion are connected at one end.

* * * * *